US005715557A

United States Patent [19]

Hsu

[11] Patent Number: 5,715,557

[45] Date of Patent: Feb. 10, 1998

[54] MACHINE FOR AUTOMATICALLY CLEANING THE OUTER WALL OF A HIGH-RISE BUILDING

[76] Inventor: Po-Lin Hsu, No. 549, Sec. 3, Chung Shan Rd., Ching-Feng Village Chi-An Hsiang, Hualian Hsien, Taiwan

[21] Appl. No.: 784,011

[22] Filed: Jan. 15, 1997

[51] Int. Cl.[6] ..... A47L 1/02

[52] U.S. Cl. ..... 15/50.3; 15/52.1; 15/103

[58] Field of Search ..... 15/50.3, 52, 52.1, 15/103, 302

[56] References Cited

U.S. PATENT DOCUMENTS

| | | | |
|---|---|---|---|
| 3,292,193 | 12/1966 | Littin | 15/50.3 |
| 3,298,052 | 1/1967 | Wolfe | 15/50.3 |
| 5,465,446 | 11/1995 | Chang | 15/50.3 |

FOREIGN PATENT DOCUMENTS

| | | | |
|---|---|---|---|
| 250862 | 4/1964 | Australia | 15/50.3 |
| 2748142 | 5/1979 | Germany | 15/103 |

*Primary Examiner*—Randall Chin

*Attorney, Agent, or Firm*—Bacon & Thomas

[57] ABSTRACT

An automatic outer wall cleaning machine for a high-rise building comprises a shell, an actuator, two drum brushes and a plurality of suction cup units, in which the shell can be suspended outside high-rise buildings with cables for raising and lowering, a guide rail is placed at each lateral side in the shell to provide a support for a motor which is controlled by an actuator for upward and downward displacement, the motor's transmission shaft is extended out of the shell through a guide slot and connects to a drum brush at each side, and the drum brush is protected by a shield. Each drum brush is designed with a sleeve along its central line for insertion of the transmission shaft, and water outlets connecting to each other are designed therein. An end of the sleeve is fitted with a rotary connector for feeding of water. By rotation, raising and lowering of the drum brushes and feeding of water jet into the sleeve of the drum brushes, cleaning action is performed. Each corner of the shell is integrated with a suction cup unit with setoff adjustment to secure the machine firm to the outer wall, and an air dryer is integrated to the drum brush for air drying after water cleaning.

6 Claims, 8 Drawing Sheets

MACHINE FOR AUTOMATICALLY CLEANING THE OUTER WALL OF A HIGH-RISE BUILDING

BACKGROUND OF THE INVENTION (a) Field of the Invention

The present invention relates to an automatic outer wall cleaning machine for a high-rise building, particularly an automatic outer wall cleaning equipment which is easy to use and can be secured to an ordinary or curvilinear high-rise building.

(b) Description of the Prior Art

Generally, a manually controlled elevator cage hung with a cable is used by a worker in cleaning a high-rise building's outer wall, and a number of other persons must be deployed on the ground as well as the top of the building to provide support and control functions. Therefore, cleaning of high-rise building's outer wall can't be done with only one or two persons. Moreover, the number of high-rise buildings is increasing day by day, and the need for outer wall cleaning is also increasing. However, such kind of manual cleaning work is very dangerous and, accidents are reported frequently, but there is a need to maintain a high-rise building's appearance. Therefore, high-rise building's outer wall cleaning is not avoidable, but there is a need to shorten the cleaning cycle.

SUMMARY OF THE INVENTION

The main objective of the present invention is to provide an automatic outer wall cleaning machine for high-rise building comprising a shell, an actuator, two drum brushes and a plurality of suction cup units, particularly for automatic cleaning of the outer wall of ordinary or curvy shaped high-rise buildings. By means of an actuator and a set of linear guide rails, drum brushes driven by a motor can be controlled for upward and downward movement for cleaning action. Suction cup units are installed at selected corner of the shell so that setoff can be adjusted automatically to secure the automatic cleaning machine to the outer wall firmly regardless of the shape or condition of the outer wall. Moreover, air drying can be proceeded after water cleaning to provide an excellent cleaning effect without risk to safety of its operator.

Another objective of the present invention is to provide an automatic outer wall cleaning machine for high-rise buildings with a movable cross stop clamp designed at each lateral side of the shell in a manner that the stop clamp can be adjusted for vertical and horizontal displacement in discretion for precisely fitting to the rail on a high-rise building's outer wall so that upon raising and lowering of the shell along the rails, an optimal gap can be maintained to prevent collision with the high-rise building.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENTS

Figure 1:
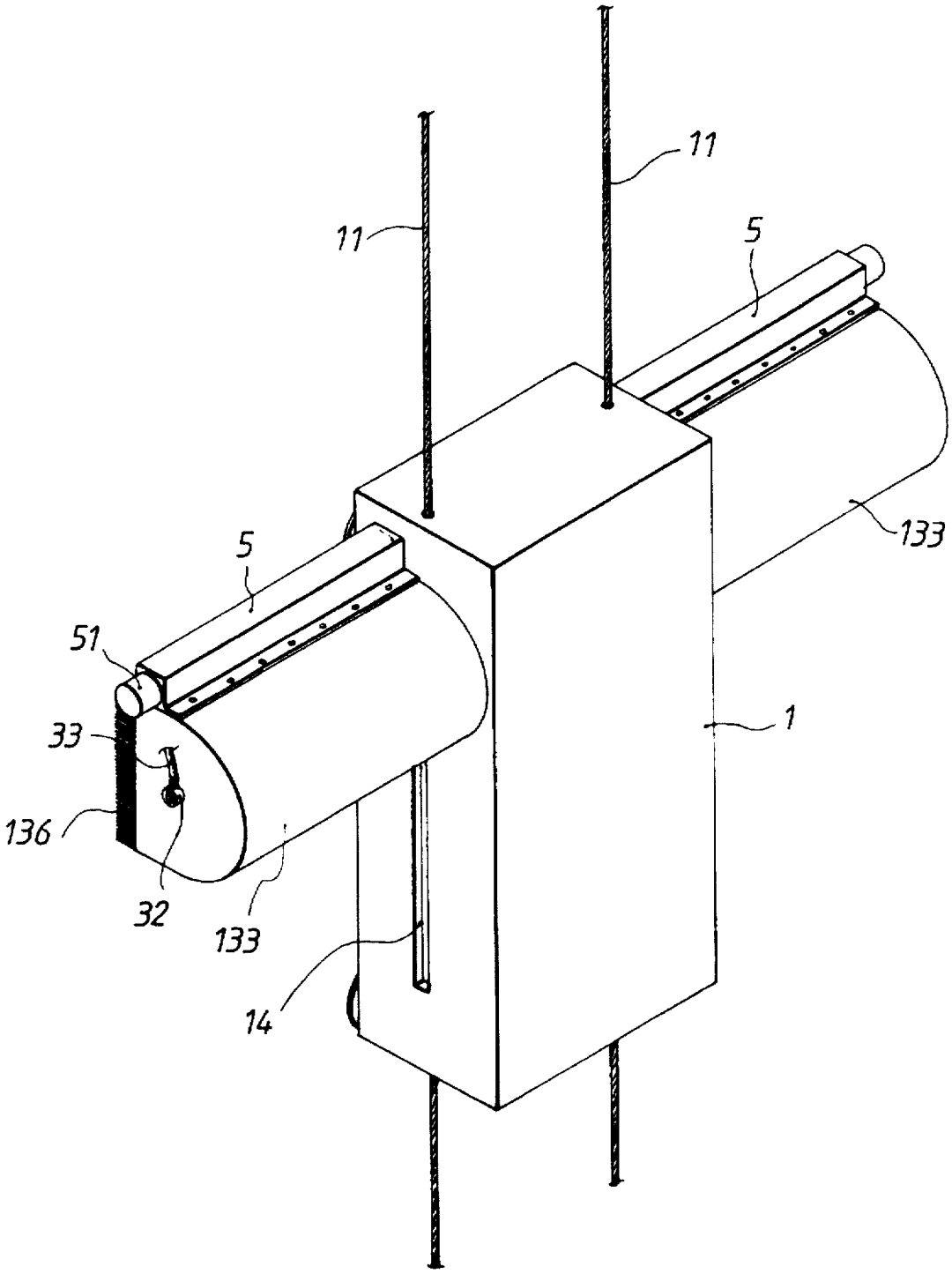
FIG. 1 is a perspective view of an automatic outer wall cleaning machine for high-rise buildings according to the present invention.
Figure 2:
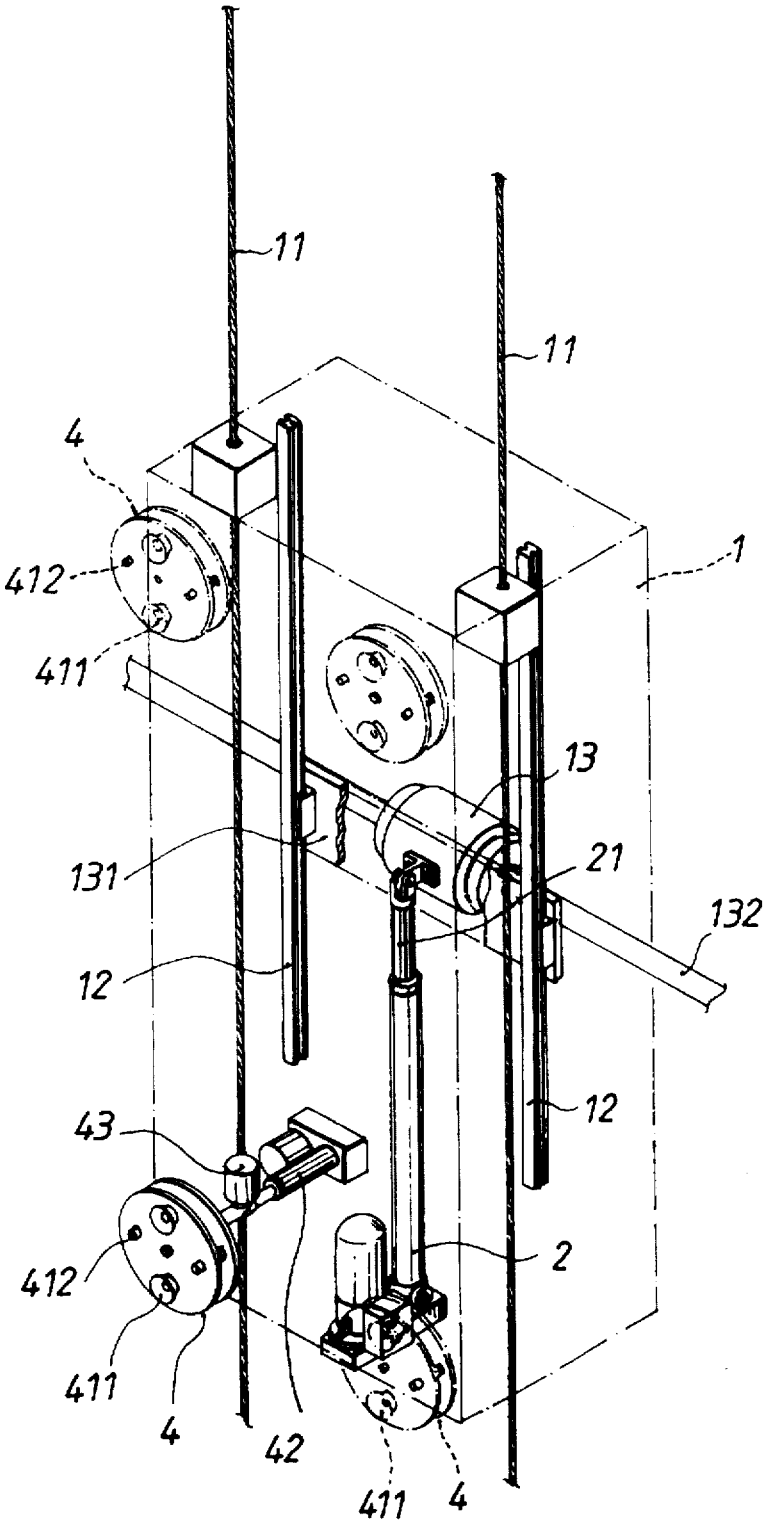
FIG. 2 illustrates an assembly of the preferred embodiment of the present invention.

As shown in FIGS. 1 and 2, the automatic outer wall cleaning machine for high-rise buildings according to the present invention comprises a shell 1, an actuator 2, two drum brushes 3 and a plurality of suction cup units 4.

The shell 1 is provided for hanging with cables 11 for raising and lowering the present invention along a high-rise building in the conventional manner. Such cables 11 are integrated with the conventional means for working along the outer wall of the high-rise building, and since their use is within the scope of prior art, they are not to be described herein. On each inner lateral side wall of the shell 1 a linear guide rail 12 is provided to support a motor 13 connected to a sliding plate 131. The vertical displacement of the motor 13 is controlled by an actuator 2 to be described below. The motor 2 has its transmission shaft 132 extended out of a guide slot 14 and connected to a drum brush 3 at each lateral side of the shell 1. Each of the drum brushes 3 is protected by a shield 133.

The actuator 2 is placed at the lower section of the interior space of the shell 1. The actuator 2 itself is a conventional linear actuator for mechanical and electric equipment to actuate linear pushing and pulling action. As it is driven by electric power, it can be operated with remote control. However, it will not be described here because it is a conventional linear actuator. In the present invention, the actuator 2 has an end of its piston rod 21 connected to the sliding plate 131 so that the motor 13 connected to the sliding plate 131 can be raised and lowered along the linear guide rail by pushing and pulling effect of the actuator 2.

Figure 3:
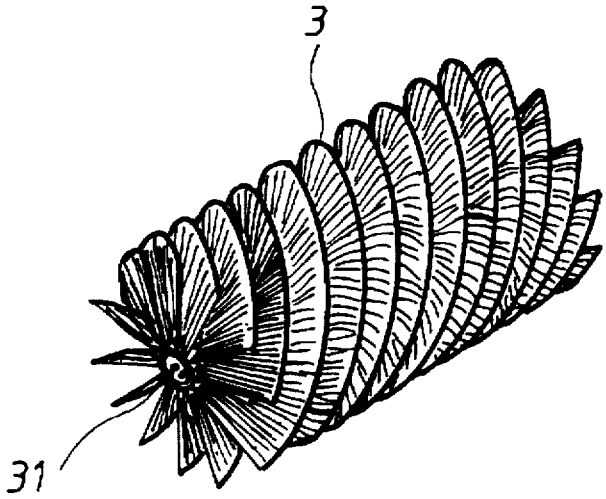
FIG. 3 is a perspective view of the drum brush according to the present invention.
Figure 4:
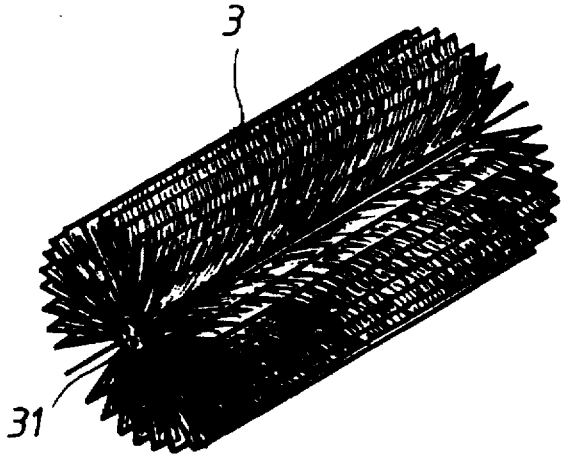
FIG. 4 is a perspective view of another embodiment of the drum brush according to the present invention.
Figure 5:
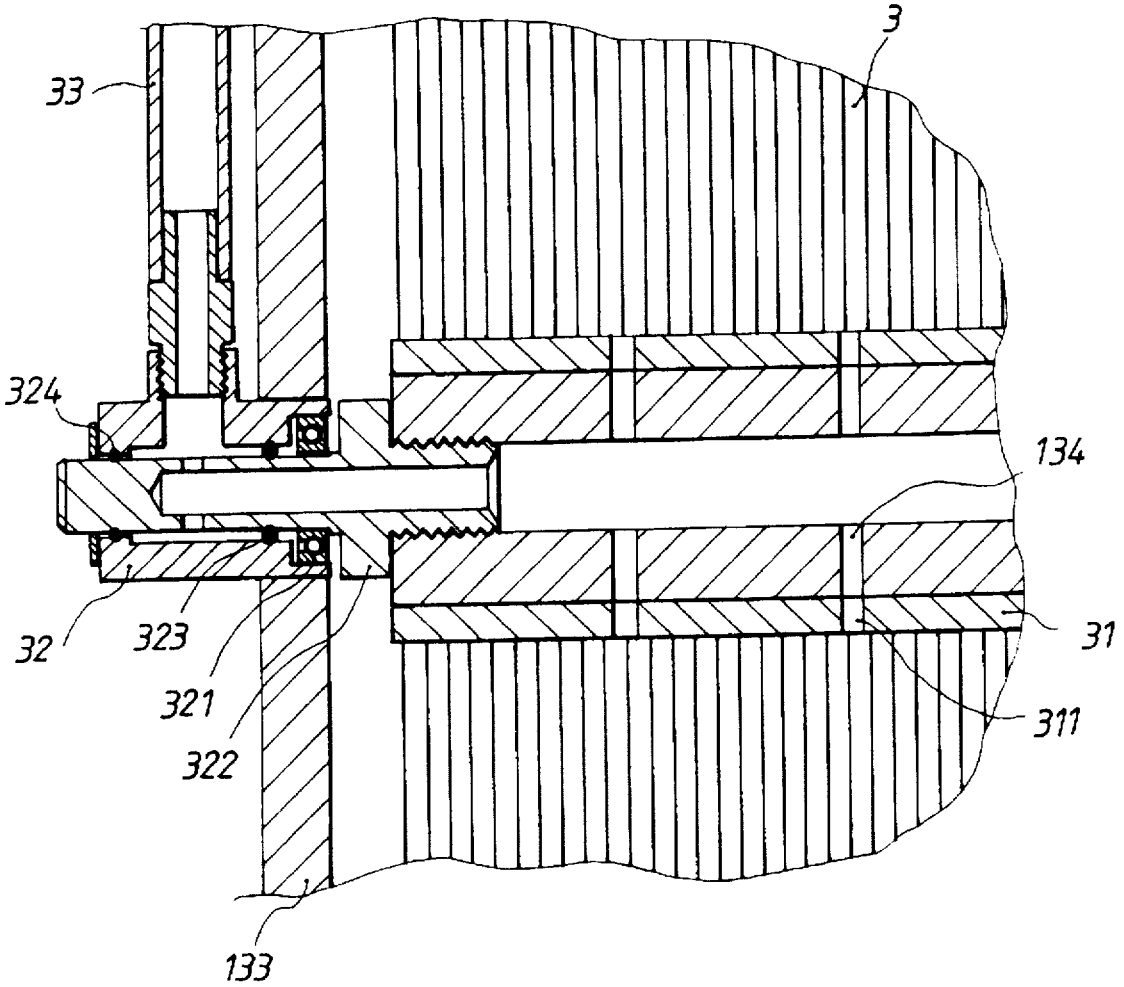
FIG. 5 is a sectional view illustrating assembly of the drum brush, transmission shaft and water connector.

As shown in FIGS. 3 and 4, respectively, each drum brush 3 can be a spirally wound or radiating brush the replacement of which can be done easily whenever necessary. Along the central line of the drum brush 3 a sleeve 31 is provided for connection to the transmission shaft 132 as shown in FIG. 5. The sleeve 31 is designed with water outlets 134 and 311 connecting to each other after its installation. An end or each of its both ends of the sleeve 31 is connected to a rotary connector 32 which is then connected to a water supply hose 33 for supply of water as a water jet to provide a high-speed water flow spraying out from the water outlets 134, and the drum brushes 3 can be rotated (driven via the transmission shaft 132) raised and lowered by the actuator 2 to provide a cleaning action with automatic raising and lowering movement. The rotary connector 32 is a conventional component which has been extensively used in this field and includes a bearing 321 and a sleeve 322 to provide a stable locking effect and allow free rotation, and it comprises water stop gaskets 323 and 324 to prevent leakage, but it will not be described herein because it is a conventional structure in the prior art.

Figure 6:
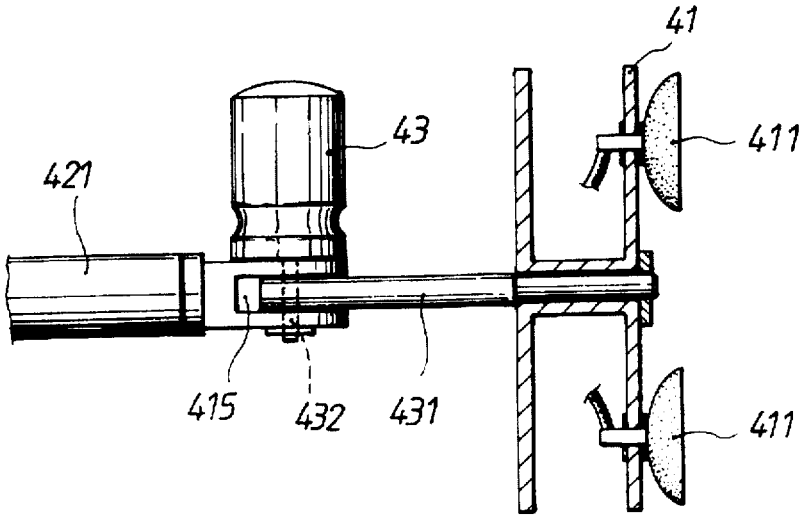
FIG. 6 illustrates a suction cup unit according to the present invention.
Figure 7:
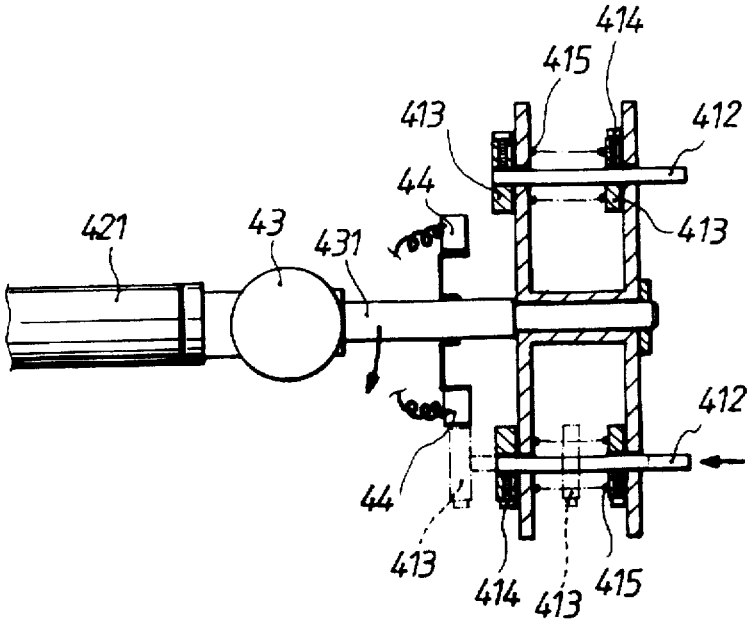
FIG. 7 illustrates assembly and action of the sensor and probes in the suction cup unit according to the present invention.

Each suction cup unit 4, as shown in FIGS. 6 and 7, is installed at a selected corner on the outside of the shell 1. It is preferred that one suction cup unit 4 be installed at each of the four corners facing the outer wall, as shown in drawings of the preferred embodiment of the present invention. Each suction cup unit 4 comprises a cup holder 41, a small actuator 42, a control motor 43 and a sensor 44.

The cup holder 41 is an H-shaped structure which supports one or more vacuum suction cups 411 on its bearing surface. On the bearing surface a probe 412 to detect distance is installed on each lateral side. The probe 412 is locked with two locking plates 413 by means of bolts 414 with a spring 415 fixed between the locking plates 413 in order to maintain it within the cup holder 41 and to allow the probe 412 to retract automatically when it contacts a foreign object, thereby actuating the sensor 44 described below.

The small actuator 42 is fixed to the wall of the shell 1 in a manner that an end of the actuator piston rod 421 is connected to the control motor 43 which is integrated with an offset rod 431 passing through the cup holder 41 and fixed to the cup holder 41 to control the cup holder 41 for linear displacement. The motor 43 is installed at the end of the piston rod 421 with its transmission shaft 432 vertically passing through a transverse opening 415 of the piston rod 421 and the offset rod 431 to drive and control offset movement of the offset rod 431.

The sensor 44 is fixed at the offset rod 431 at an appropriate position to actuate the motor 43 in order to displace the offset rod 431 to a certain angle toward the probes 412 as shown by the arrow illustrated in FIG. 7 whenever any of the probes 412 contact a foreign object. Alternatively, an infrared sensor can be used to actuate the motor 43 when any object is detected within a certain distance from the sensor. However, when the other two probes 412 contact with the high-rise building's outer wall, the sensor 44 causes both the small actuator 42 and the motor 43 to stop simultaneously. At that moment, the vacuum suction cups 411 are perpendicular to the high-rise building's outer wall, and consequently the vacuum suction cups 411 can be attached to the outer wall 9 to permit cleaning of the outer wall.

For cleaning of any high-rise building's outer wall with an assembly comprising the components described above, the shell 1 is suspended at a designated cleaning position with the cables 11. The small actuator 42 of the respective suction cup units 4 displaces forward. When any of the probes 412 at the suction cup holder 44 retracts as it makes contact with the outer wall, the sensor is actuated to adjust for the offset angle automatically. When the vacuum suction cups 411 are perpendicular to the outer wall, the vacuum suction cups 411 can be attached to the outer wall. By operation of the related circuit, i.e., operation of the actuator 2, the linear guide rails 12 and the motor 13 to drive the drum brushes 3 and feeding of a water jet, the cleaning process can be carried out as shown in FIG. 8.

Figure 8:
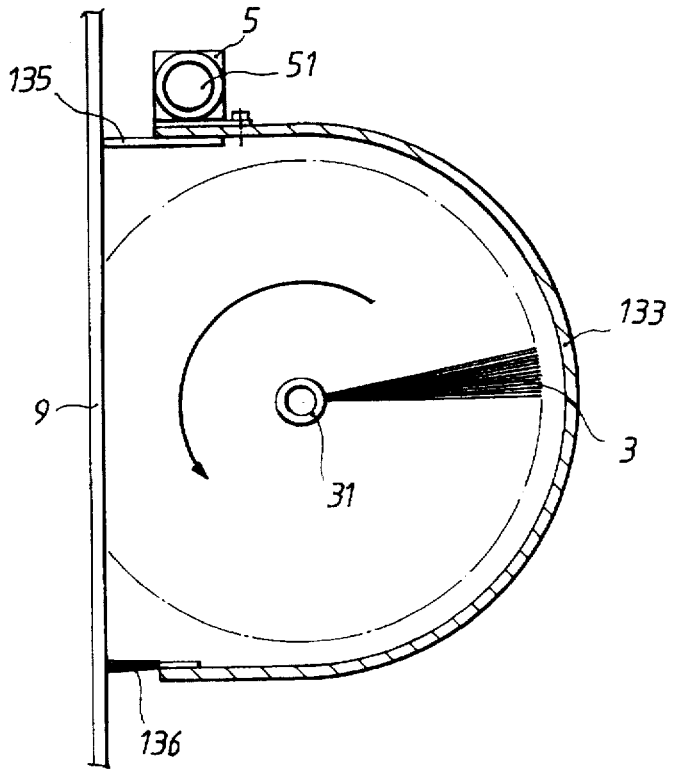
FIG. 8 illustrates cleaning action performed by the drum brush according to the present invention.

As shown in FIG. 8, a wiper 135 in the form of a long strip is fixed to the upper edge of the shield 133 facing the outer wall to provide an excellent wiping effect when the automatic cleaning machine is moved downward in an air drying process described below. The shield 133 can be further designed with appropriate wire brushes 136 at its lower edge and two lateral sides as shown in FIGS. 1 and 8 so that spraying of water is restricted within the shield 133 to provide a good cleaning effect as the wire brushes 136 can block the water from spraying out of the shield.

An air dryer 5 with a motor 51 and an appropriate control circuit is further placed on each shield 133 for drying the outer wall with air after cleaning with water. According to the design of the present invention, the water cleaning process is done by pushing the cleaning machine upward from the bottom to the top of the building by means of the actuator 2, and the air drying process is carried out from the top to the bottom of the building after completion of the water cleaning process to provide a continuous cleaning and drying procedures.

Figure 9:
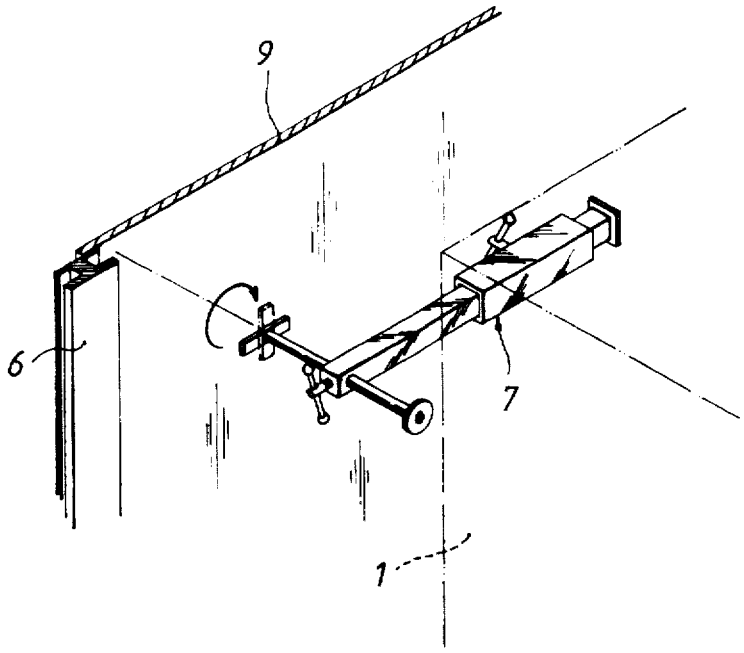
FIG. 9 illustrates the use of cross a stop clamp according to the present invention.
Figure 10:
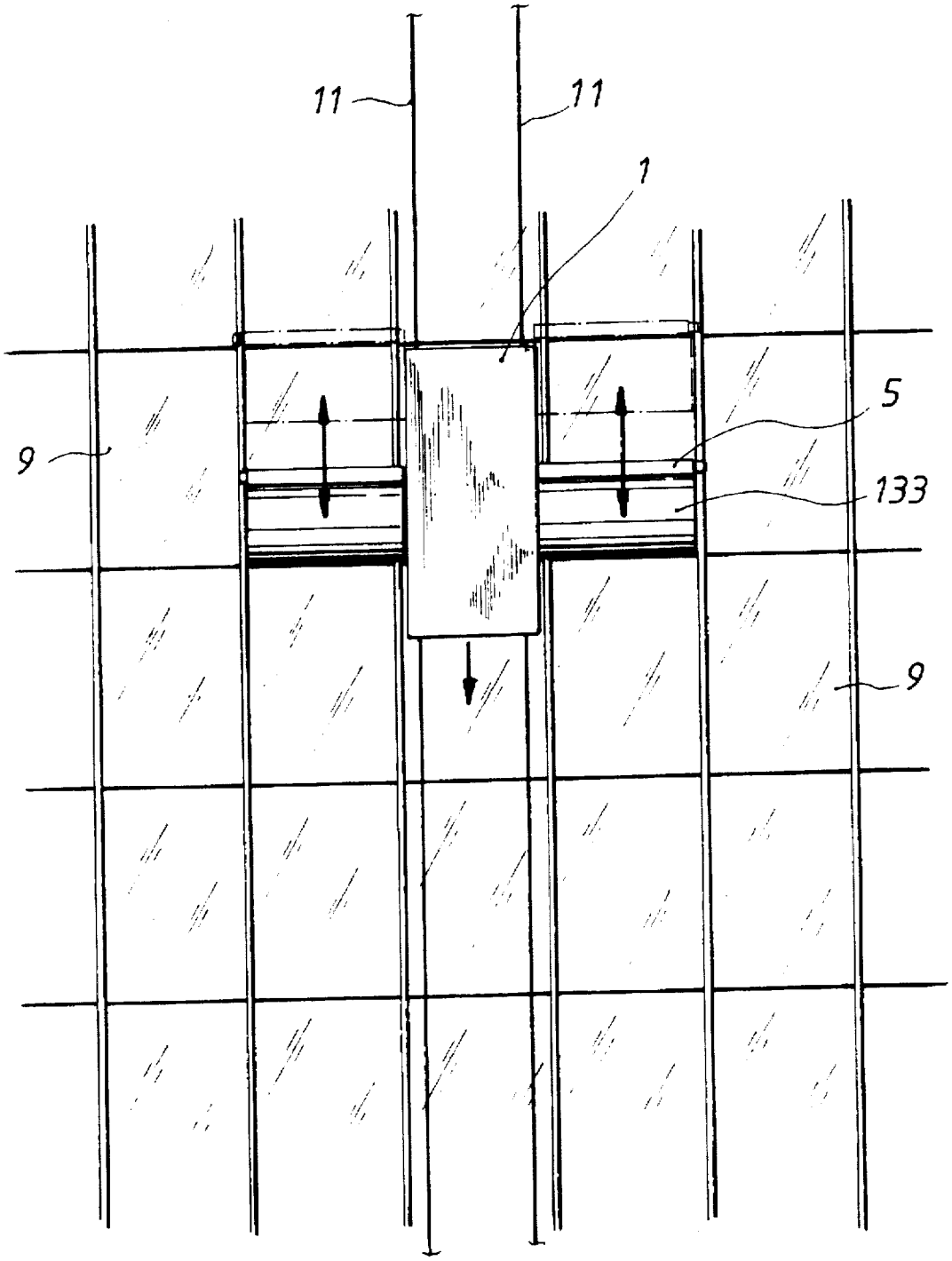
FIG. 10 illustrates cleaning of a high-rise building's outer wall with the present invention.

For high-rise buildings designed with rails 6 on its outer wall, as shown in FIGS. 9 and 10, a movable cross stop clamp 7 can be placed at each lateral side of the shell 1 in a manner that the stop clamp 7 can be adjusted for vertical and horizontal displacement in discretion for precisely fitting to the rail 6 on the outer wall of the building. Then, upon raising and lowering of the shell along the rails, the optimal gap can be maintained to prevent collision with the high-rise building.

Figure 11:
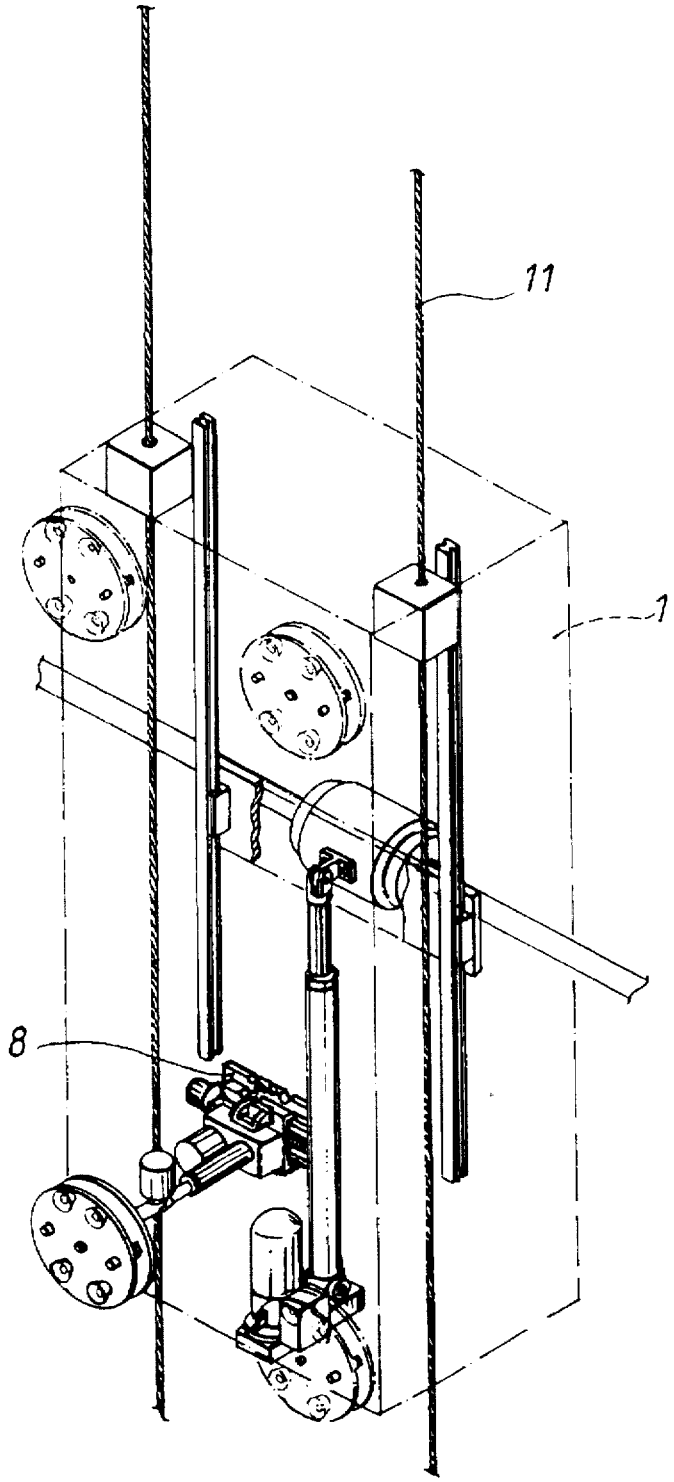
FIG. 11 illustrates installation of a cross sliding block to the present invention.

As shown in FIG. 11, the suction cup unit 4 according to the present invention can further include a conventional cross sliding block 8 on its bottom for displacement adjustment so that it can be attached to any particular outer wall condition, such as to an outer wall position where there is a groove or projection.

Many changes and modifications in the above embodiment of the invention can, of course, be carried out without departing from the scope thereof. Accordingly, to promote the progress in science and the useful arts, the invention is disclosed and is intended to be limited only by the scope of the appended claims.

I claim:

1. A machine for automatically cleaning the outer wall of a high-rise building, the machine comprising:

a) a shell suspendable by means of cables for raising and lowering the shell along an outer wall of a high-rise building, the shell including a pair of inner lateral walls, a linear guide rail at each inner lateral wall, a sliding plate secured to the guide rails, a first motor mounted to the sliding plate, a first actuator for raising and lowering the sliding plate, a guide slot formed in each lateral wall, the first motor including a transmission shaft extending out of each guide slot, a dram brush mounted on each transmission shaft and disposed at a lateral side of the shell, and a shield enclosing each drum brush;

b) the first actuator being disposed at a lower section of the shell for providing linear pulling and pushing action, the first actuator including a piston rod having an end connected to the sliding plate;

c) each drum brush including a central sleeve connecting the brush to the transmission shaft, the sleeve including a plurality of water outlets, a rotary connector connecting an end of the sleeve to a water supply hose for supplying water to the water outlets and the drum brushes being rotatable by the transmission shafts and raisable and lowerable by the actuator to provide a cleaning action;

d) a plurality of suction cup units, each unit being installed at an exterior corner of the shell and including a cup holder, a second actuator, a second motor and a sensor;

e) the cup holder being of an H-shaped configuration and including a bearing surface on which at least one vacuum suction cup is supported, a pair of retractable probes secured to the cup holder, the probes being automatically retractable upon contact with the outer wall of the building for actuating the sensor;

f) each second actuator being secured to a wall of the shell and including an end connected to the second motor, an offset rod extending through the cup holder and connected to the second motor for linear displacement of the cup holder; and g) the sensor being fixed to the offset rod for actuating the second motor and angularly displacing the offset rod toward the probes whenever a probe contacts the outer wall of the building and simultaneously deactivating operation of both the second actuator and the second motor when the vacuum suction cups are disposed perpendicular to the outer wall of the building, thereby permitting the suction cups to be attached to the outer wall and permit the cleaning thereof by the drum brushes.

2. The machine of claim 1 wherein each shield includes an upper edge for facing the outer wall of the building and an elongate wiper strip secured to the upper edge for wiping the outer wall when the machine is moved downward in an air drying process.

3. The machine of claim 1 wherein each shield further includes a lower edge and a pair of lateral sides, and a wire brush disposed at the lower edge and each lateral side.

4. The machine of claim 1 wherein each shield further includes a motor-driven air dryer and a control circuit for operating the motor to dry the outer wall of the building with air after cleaning with water.

5. The machine of claim 1 further including a moveable cross stop clamp disposed at each lateral side of the shell, each clamp being adjustable for vertical and horizontal displacement for precisely fitting the machine to an existing raft on the outer wall of the high-rise building, thereby providing a gap between the machine and the outer wall and preventing collision therebetween during raising and lowering of the machine.

6. The machine of claim 1 wherein each suction cup unit further includes a cross sliding block on a bottom thereof for permitting displacement adjustment of the unit and secure attachment thereof to the outer wall of the building.

* * * * *